US007520018B2

(12) United States Patent
Libman et al.

(10) Patent No.: US 7,520,018 B2
(45) Date of Patent: Apr. 21, 2009

(54) MOP WITH ATTACHED WRINGER

(75) Inventors: Robert J. Libman, Arcola, IL (US); Enzo Berti, Dolo (IT); Marco Bizzotto, Padova (IT); Roberto Pellacini, Parma (IT)

(73) Assignee: The Libman Company, Arcola, IL (US)

( * ) Notice: Subject to any disclaimer, the term of this patent is extended or adjusted under 35 U.S.C. 154(b) by 680 days.

(21) Appl. No.: 11/189,127

(22) Filed: Jul. 25, 2005

(65) Prior Publication Data

US 2006/0016032 A1 Jan. 26, 2006

Related U.S. Application Data

(63) Continuation-in-part of application No. 10/356,896, filed on Feb. 3, 2003, now Pat. No. 6,920,664, which is a continuation-in-part of application No. 29/145,583, filed on Jul. 25, 2001, now Pat. No. Des. 474,869.

(51) Int. Cl.
*A47L 13/14* (2006.01)
*A47L 13/142* (2006.01)
*A47L 13/20* (2006.01)

(52) U.S. Cl. ..... 15/120.1; 15/119.1; 15/147.1; 15/229.2

(58) Field of Classification Search ..... 15/116.1, 15/119.1, 120.1, 120.2, 147.1, 228, 229.1, 15/229.2
See application file for complete search history.

(56) References Cited

U.S. PATENT DOCUMENTS 957,025 A * 5/1910 Zachry ..... 15/229.2
1,073,612 A * 9/1913 Lockhart ..... 15/229.1
1,138,922 A * 5/1915 Allen ..... 15/229.1
1,273,768 A * 7/1918 Gilliam ..... 15/120.2
1,479,263 A * 1/1924 Sturgis ..... 15/228
1,557,894 A * 10/1925 Sturgis ..... 403/342
3,462,788 A * 8/1969 Abbott ..... 15/119.1
5,060,338 A * 10/1991 Yates et al. ..... 15/119.2
5,509,163 A 4/1996 Morad
5,581,839 A 12/1996 Ferrell, Jr.
D387,526 S 12/1997 Berti
D387,527 S 12/1997 Specht
5,976,266 A * 11/1999 Anderson et al. ..... 134/6
6,108,848 A 8/2000 Monahan
6,212,728 B1 4/2001 Facca

FOREIGN PATENT DOCUMENTS

ES 2117588 8/1998
GB 1586313 3/1981
WO 96/32048 * 10/1996

* cited by examiner

*Primary Examiner*—Mark Spisich
(74) *Attorney, Agent, or Firm*—Banner & Witcoff, Ltd.

(57) ABSTRACT

A mop with an attached wringer cup has a set of perforations near the outwardly tapering lower end of the wringer cup. The wringer cup includes a rib. Along a side portion of the rib a plurality of perforations may be provided. In an embodiment the perforations may increase in size toward the end of the wringer cup. A connector may be provided to secure the mop head to the handle. In an embodiment the connector may accept a collar without requiring the collar to have a particular rotation orientation.

14 Claims, 7 Drawing Sheets

MOP WITH ATTACHED WRINGER

This is a continuation-in-part of application Ser. No. 10/356,896 filed on Feb. 3, 2003, now U.S. Pat. No. 6,920,664 which is a continuation-in-part of application Ser. No. 29/145,583, filed on Jul. 25, 2001, now U.S. Pat. No. D474, 869. The present invention relates generally to mops, and more particularly to mops with attached wringer cups.

BACKGROUND OF THE INVENTION

One type of mop that has found commercial success is in the marketplace is a mop having an attached wringer cup, like the one disclosed in U.S. Pat. No. 5,060,338. Other examples may be found in U.S. Pat. Nos. 1,709,622; 3,364,512; 3,946, 457; and 4,809,287; and German published patent Application No. DE 3607121 A1.

The wringer cups used on these kinds of mops often have grooves or ribs on the inside. When the cone-shaped wringer cup is pushed down over the mop fibers, the ribs help to squeeze water out of the mop fibers. The wringing is not always completely effective, however. Some of the water that has been squeezed out of the mop fibers can sometimes reenter the fibers before draining completely out of the wringer cup.

SUMMARY OF THE INVENTION

The applicant has developed an innovative wringer cup and connector assembly for the mop fibers. In an embodiment the wringer cup has holes in it that may permit water to drain out of the wringer cup more quickly and effectively so as to help prevent re-absorption. In an embodiment the wringer cup includes inwardly directed ribs and the ribs include perforations to enhance the draining of water from the mop fibers. In an embodiment the connector assembly may be configured to allow for easier assembly of the mop fibers to a mop handle.

BRIEF DESCRIPTION OF THE DRAWINGS

The invention may be better understood by referring to the accompanying drawings, in which.

DETAILED DESCRIPTION

Figure 1:
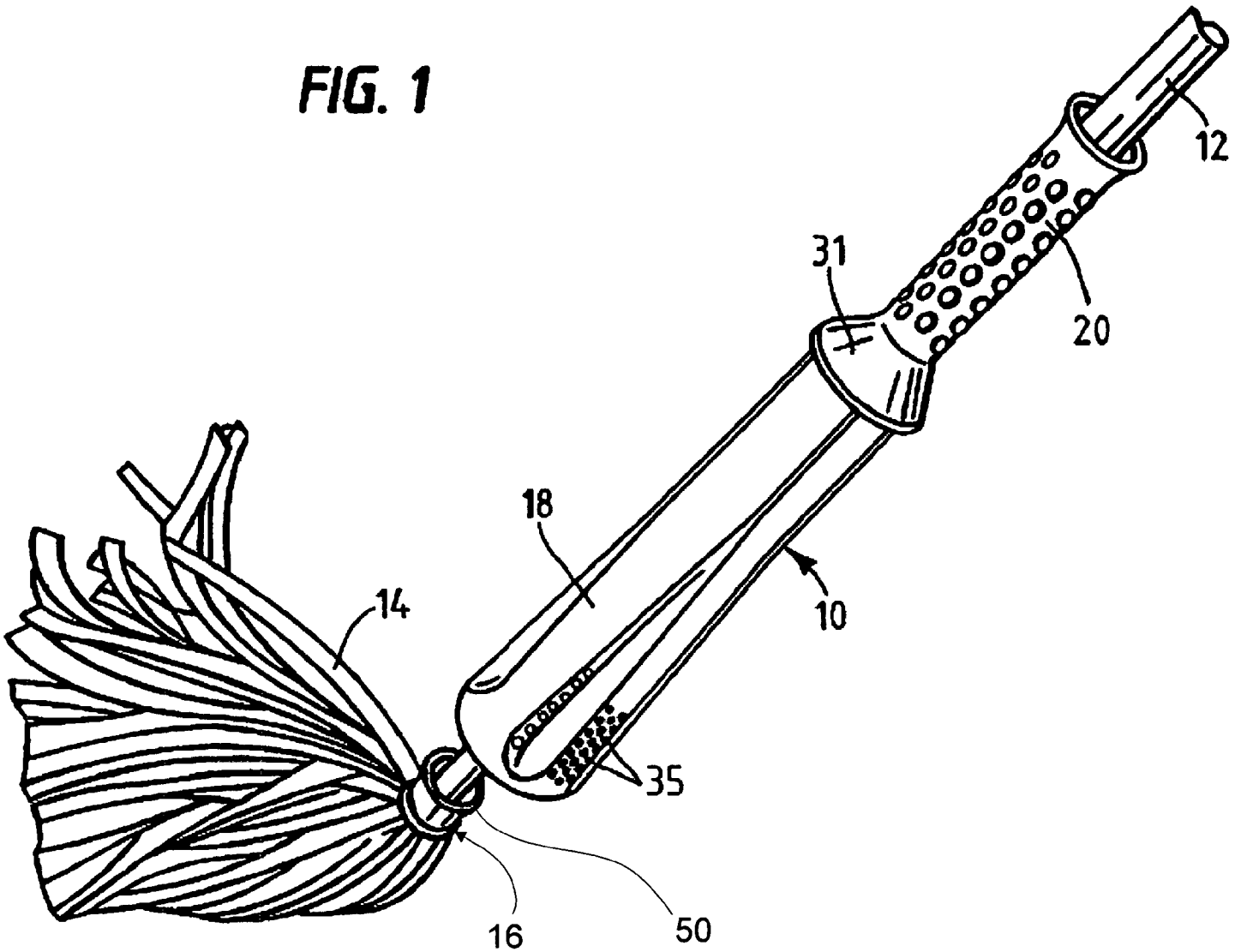
FIG. 1 is a perspective view of a wringer mop in accordance with one embodiment of the invention.

FIGS. 1-4 show one embodiment of a mop 10 in accordance with the present invention. Like conventional wringer mops, the illustrated mop includes a handle 12, a set of mop elements 14 on an end 16 of the handle 12, and a wringer cup 18. To fasten the mop elements 14 to the end 16 of handle 12, a connector assembly 50 is provided.

It is conventionally known that the handle for such mops can be a lightweight metal tube. The illustrated handle includes an optional hand grip 20, discussed below.

The mop elements 14 that are illustrated take the form of flat strips. It is conventionally known that such strips can be made from (for example) water-absorbing non-woven fibrous material that is around 18 or 19 inches long and about 0.15 inch thick in its non-compressed state. Other materials could also be used.

Figure 3:
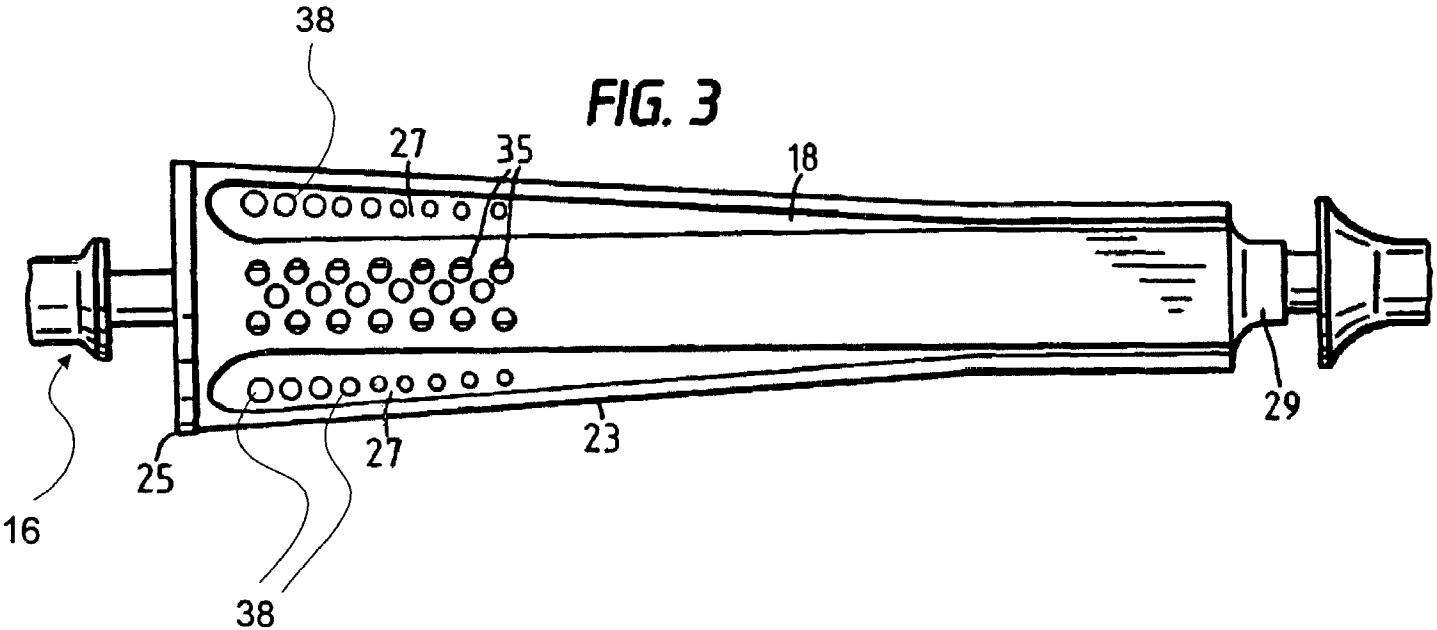
FIG. 3 is an enlarged side elevational view of the wringer cup depicted in FIG. 1.
Figure 4:
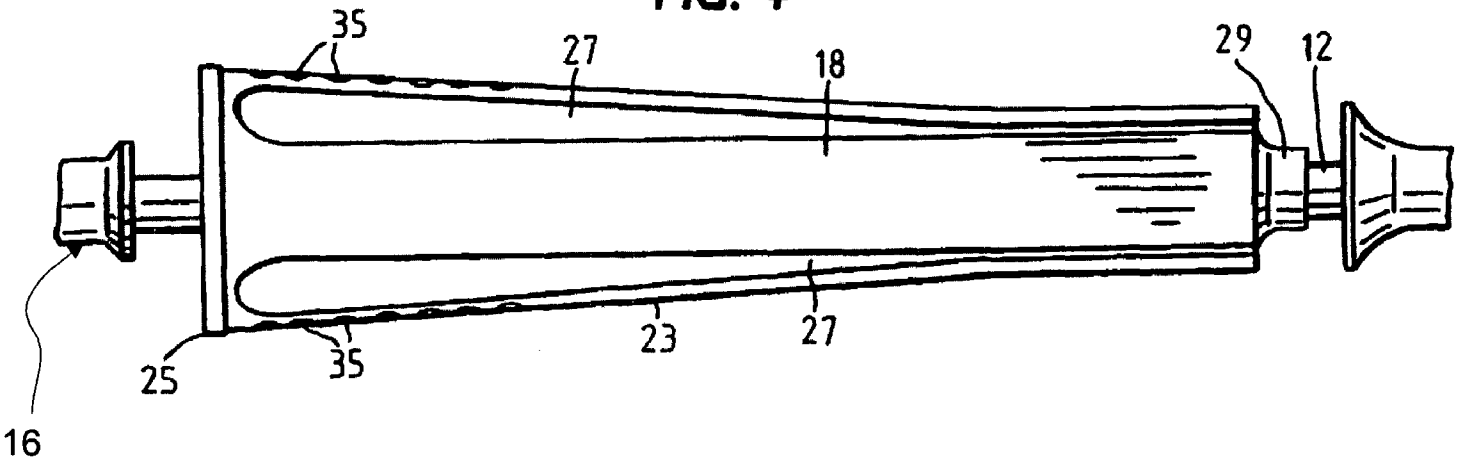
FIG. 4 is a rotated side view of the wringer cup depicted in FIG. 3.

As seen in FIGS. 3 and 4, the illustrated wringer cup 18 is disposed on the handle 12 above the mop elements 14, and has an outer wall 23 that tapers outwardly toward a lower end 25. The precise shape and arrangement of the wringer cup is not important to the invention. It is conventionally known that wringer cups used on such mops are preferably slidably mounted on the handle, and may take the form of a tubular shell that can be molded in one piece from a polymeric material such as polypropylene. It is also conventionally known that such wringer cups may include ribs 27 that help to squeeze liquid from the mop fibers during wringing.

Figure 2:
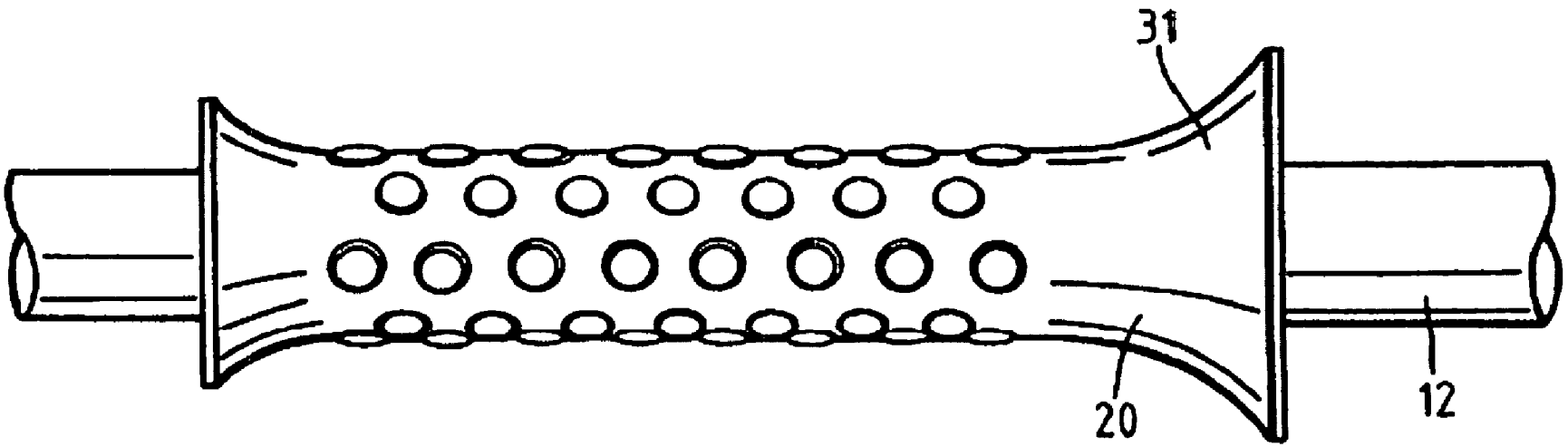
FIG. 2 is an enlarged side elevational view of the handgrip depicted in FIG. 1.

The optional hand grip 20 that has been illustrated in FIG. 2 is mounted on the handle 12, above the mop elements 14. The hand grip is arranged to hold the wringer cup 18 above the mop elements fibers when the mop is being used. This position is illustrated in FIG. 1, in which an upper portion 29 of the wringer cup (seen in FIG. 3) fits within a lower part 31 of the handgrip.

The mop elements 14, which may also be referred to collectively as a mop head, tend to be highly absorbent so as to enable the mop 10 to pick up spills. This absorbency means, however, that when removing the water from the mop elements 14 the water in the vicinity of the mop elements 14 tends to be re-absorbed. The perforations 35 in the wringer cup 18 help allow the water being squeezed from the mop elements 14 to be transported away so as to reduce re-absorption.

The present mop 10 differs from previously known mops with wringer cups in the perforations 35, 38 on the wringer cup 18. As best seen in FIGS. 1, 3, 5 and 13, the illustrated perforations are disposed near the lower end 25 of the wringer cup. As seen in FIGS. 1 and 3, the illustrated perforations preferably have a width that is no more than about one-third the diameter of the handle 12, and are less than the width of the flat strips that form the mop elements 14 on the end of the handle.

Figure 5:
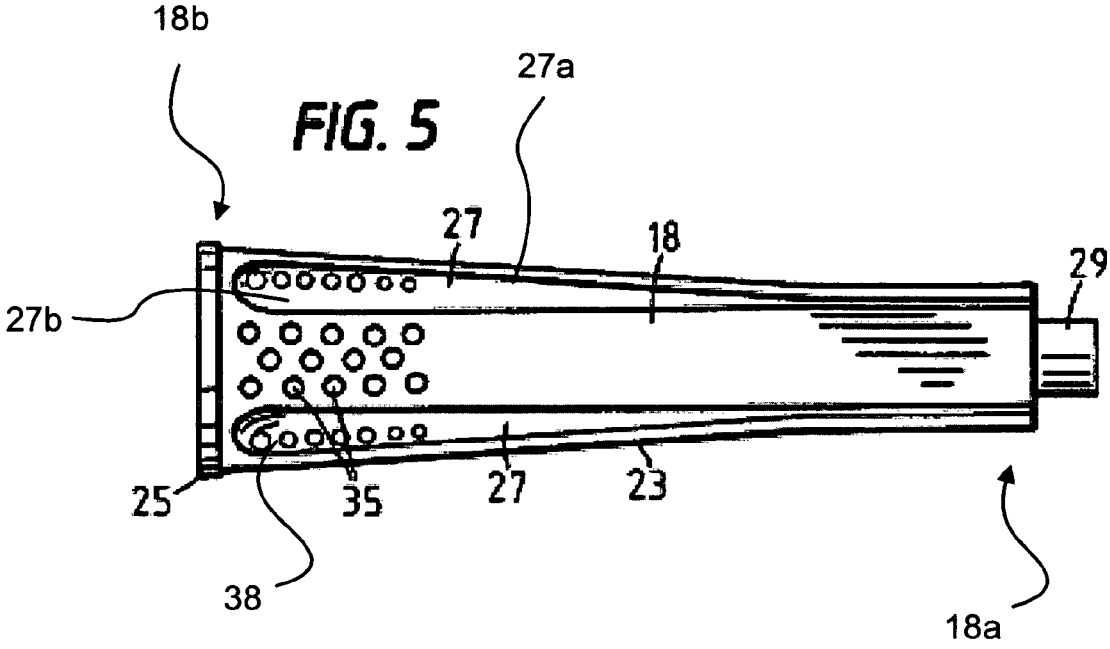
FIG. 5 is an enlarged side elevational view of a second embodiment of the wringer cup.

While the perforations 35 are helpful, additional pathways for removing the water would be useful. As seen in FIGS. 1, 3 and 5, the ribs 27 may include a plurality of perforations 38, such as arranged in a linear manner. However, the perforations 38 are preferably located to a side 27*a* rather then on a center 27*b* of the ribs 27 so as to not interfere with the compressing of the mop element 14 by the ribs 27 in effecting removal of water. As apparent from FIGS. 3, 5 and 13, the wringer cup 18 includes a first end 18*a* and a second end 18*b*. As can be appreciated, the size of the perforations 35, 38 may be substantially uniform or may be increased from smaller to larger moving towards the second end 18*b* of the wringer cup 18. This is useful for permitting more water to be squeezed out near the second end 18*b* than the first end 18*a* of the wringer cup 18. In other embodiments, different configurations and size patterns, such as alternating smaller and larger, of perforations may be used.

Figure 6:
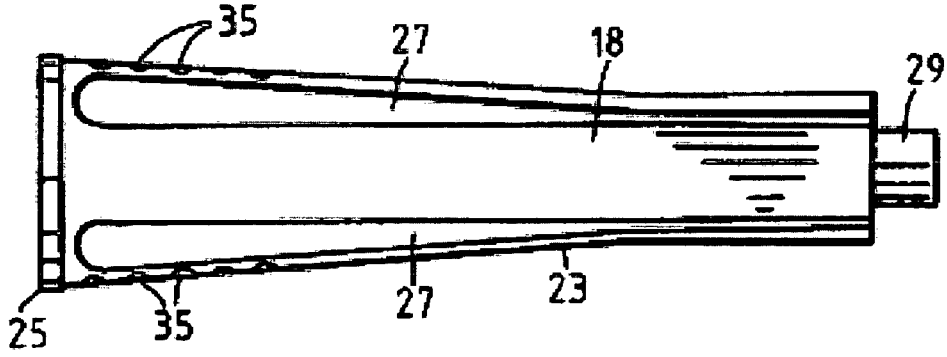
FIG. 6 is a rotated side view of the wringer cup depicted in FIG. 5.
Figure 7:
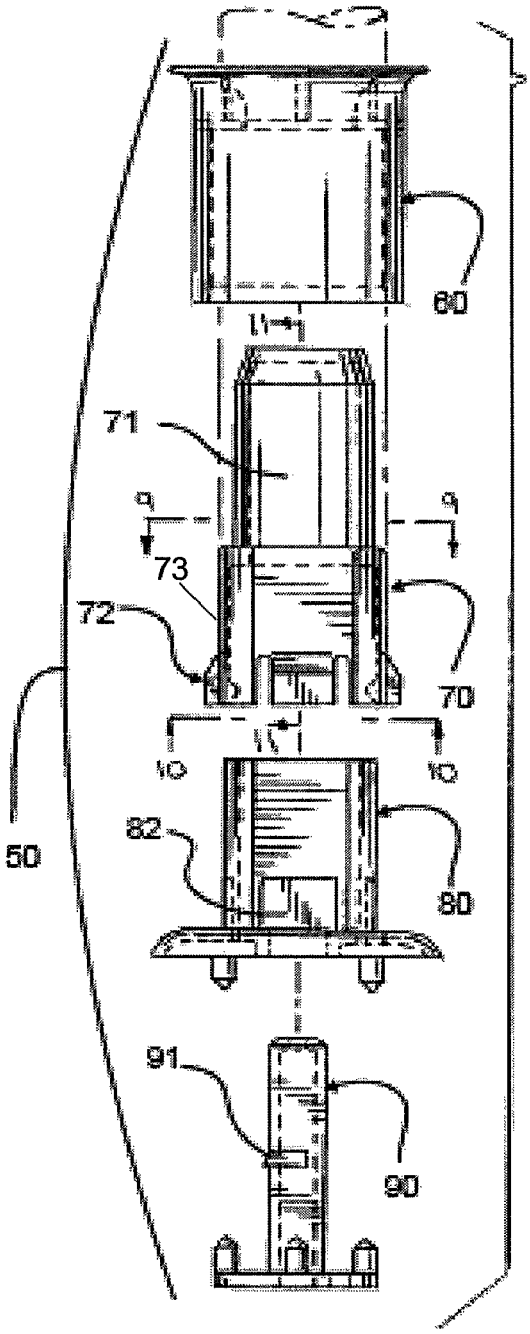
FIG. 7 is an exploded side view of an embodiment of a connector assembly in accordance with one embodiment of the invention.

FIG. 6 illustrates a side view of the wringer cup depicted in FIG. 5. It should be noted that because of the angle, the perforations 38 in the ribs 27 are not visible. In an embodiment, one or two of the ribs 27 may include the perforations 38. In another embodiment all of the ribs include the perforations on one or both of the sides of the ribs 27 and the perforations are aligned between ribs.

Turning to FIGS. 7-12, features of an embodiment of the connector assembly 50 are illustrated. Looking at FIG. 7, the connector assembly 50 includes a collar 60 configured to be installed over an insert 70. The insert 70 includes a tubular end 71 that is positioned within the handle 12. The insert 70 further includes a plurality of tabs 72 on the side walls 73 of the insert 70. The insert 70 supports the inner member 80, and the plurality of tabs 72 engage a plurality of depressions 82 on the inner member 80. In turn, the inner member 80 is configured to engage the outer member 90 so as to hold the mop element 14 in place. In an embodiment, the outer member 90 is inserted into the inner member 80 and the catch 91 holds the outer member 90 in place.

Figure 9:
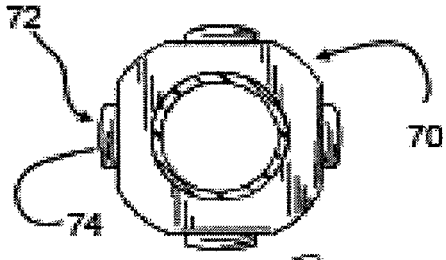
FIG. 9 is a sectional view taken along the line 9-9 in FIG. 7.
Figure 10:
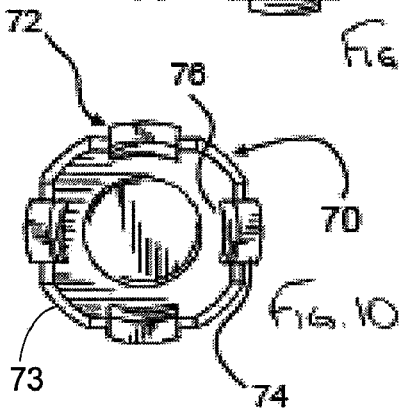
FIG. 10 is a sectional view taken along the line 10-10 in FIG. 7.
Figure 11:
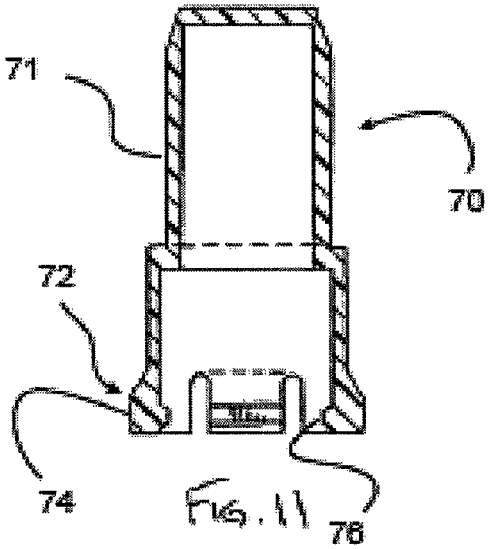
FIG. 11 is a cross-sectional view taken along the line 11-11 in FIG. 7.

FIG. 9-11 illustrate various views of the insert 70. As can be appreciated from these figures, the plurality of tabs 72 include an outer portion 74 and an inner portion 76. The inner portion 76 is configured to engage the depressions 82 on the inner member 80. The outer portions 74 each are of a size and shape suitable to provide a friction point for the collar 60 as the collar 60 is slidably installed over the insert 70 to secure the engagement of the tabs 72 with respect to the inner member 80.

Figure 8:
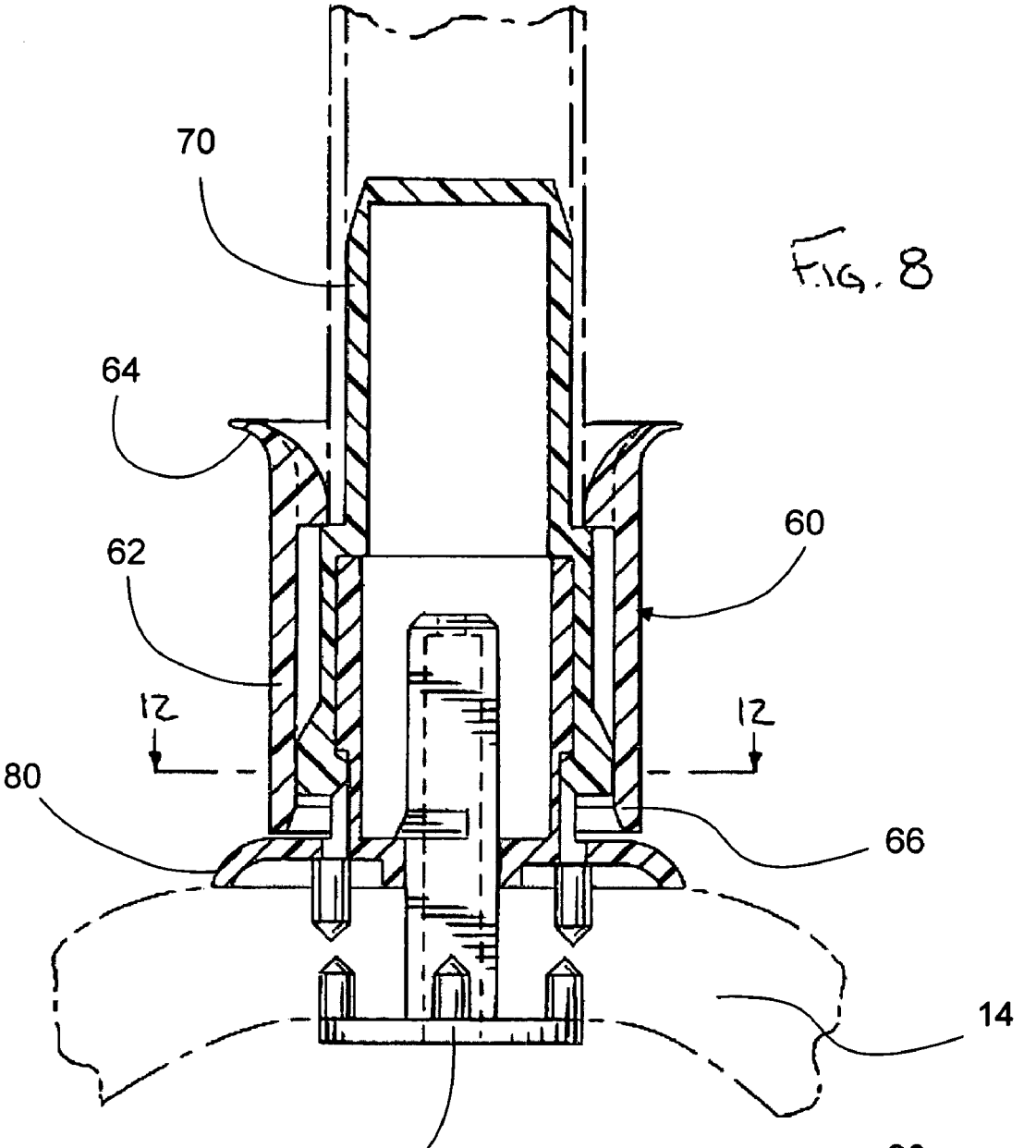
FIG. 8 is an assembled cross-sectional view of the connector assembly depicted in FIG. 7.

FIG. 8 illustrates the components of an embodiment of the connector 50 in the installed position. As depicted, the outer member 90 is inserted into the inner member 80 and together the inner and outer members 80, 90 support the mop element 14. The inner member 80 is held in position by the insert 70 and the collar 60 is positioned around the insert 70. As depicted, the collar 60 includes the chamfer wall 62 that connects the flared edge 64 to the chamfer end 66. The interior surface of the chamfer wall 62 is generally circular in cross-section to allow the collar to be slid over the insert 70 in essentially any rotational orientation. While the chamfer end 66 is not required, it helps the collar be placed in the installed position (as shown) more readily.

When the wringer cup 18 is pulled down over the mop elements 14, some of the water is forced out of the mop elements 14. To squeeze out more water, the wringer cup 18 may be rotated. As can be appreciated, however, rotating the wringer cup 18 is more effective if the mop elements 14 is help in a fixed position relative to the mop handle 12. The mop elements 14 are fixed to the handle 12 by the insert 70. When the insert 70 is installed, the friction force between the tubular end 71 and the handle 12 helps to prevent the insert 70 from moving.

As noted above, the inner and outer members 80, 90 are in turn mounted to the insert 70. Looking at FIG. 12, while the tabs 72 help hold the inner and outer members in place, to resist the twisting force, the inner and outer members 80, 90 are configured in a four sided arrangement that interfaces with the insert 70 so as to prevent rotation.

Figure 12:
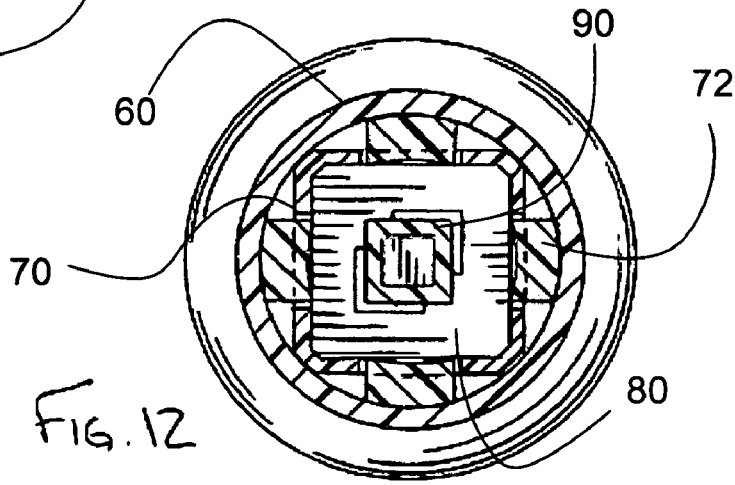
FIG. 12 is a sectional view taken along the line 12-12 in FIG. 8.
Figure 13:
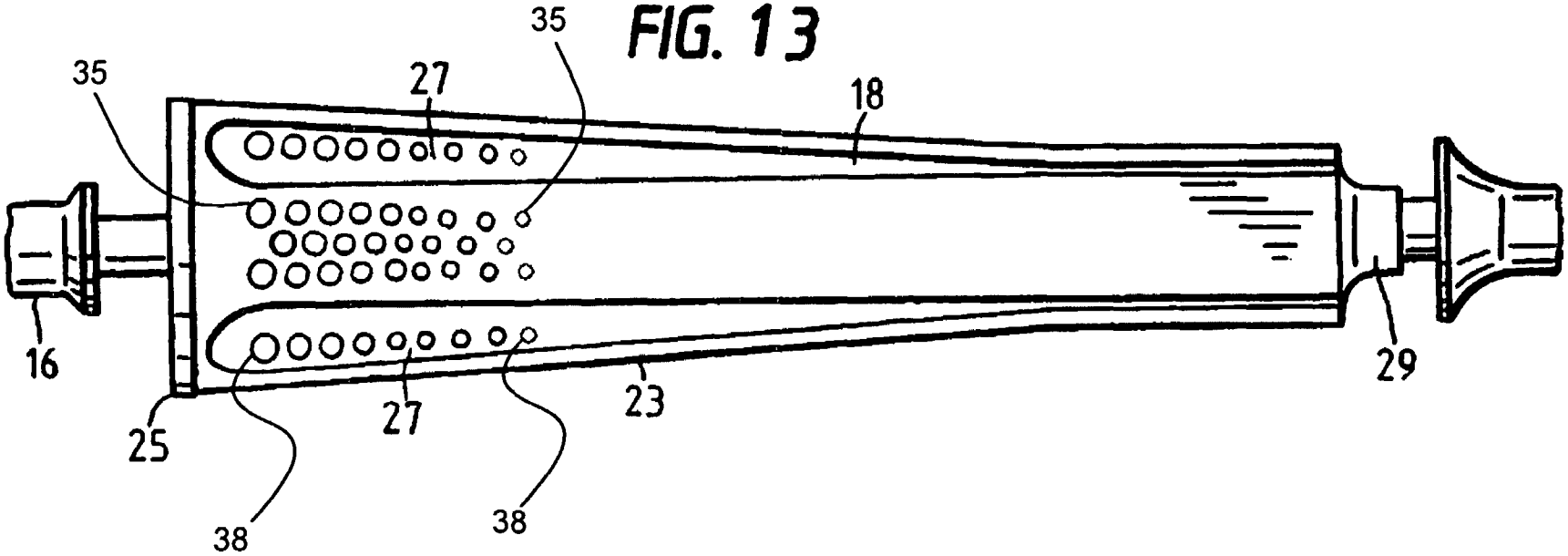
FIG. 13 is an enlarged side elevational view of a third embodiment of the wringer cup.

While the four sided arrangement is useful, configuring the collar 60 in such a corresponding configuration makes the assembly of the connector 50 more complex. Therefore, it is useful to allow the collar 60 to be installed without concern regarding its rotational orientation. To provide this functionality, in an embodiment, the tabs 72 include the outer portion 74 that extend outward. In an embodiment, as depicted in FIG. 12, the outer portion 74 of the four tabs 72 provide a circular like profile that provides a suitable frictional engagement of the collar 60.

This detailed description has been given for clearness of understanding only. Modifications may be obvious to those skilled in the art. The intended scope of the invention is set forth in the following claims.

We claim:

1. A mop comprising:

an elongate member having a first end and a second end;

a connector mounted on the second end, the connector configured to secure a mop head to the elongate member, the connector comprising:

an insert mounted to the elongate member, the insert having a plurality of tabs, the plurality of tabs having an inner portion and an outward extending outer portion that extends in a radially outward direction away from and transverse to the elongate member;

an inner member comprising a plurality of depressions configured to engage the inner portion of the plurality of tabs of the insert; and a collar having an inner wall of generally circular cross-section configured to engage the outward extending outer portion of the plurality of tabs, a grip on the elongate member between the first and second end; and a wringer cup mounted on the elongate member between the connector and the grip.

2. The mop of claim 1, wherein the collar is cylindrical in shape.

3. The mop of claim 2, wherein the plurality of tabs of the insert comprises four tabs and the inner member includes four sides with depressions for engaging the inner portion of each of the four tabs.

4. The mop of claim 1, wherein the wringer cup includes an outer wall and a rib, the outer wall including perforations and the rib including a series of perforations.

5. The mop of claim 4, wherein the wringer cup includes a first end and a second end and the perforations in the series of perforations in the rib increases in size towards the second end.

6. The mop of claim 5, wherein the rib is a first rib and the wringer cup further comprises a second rib, a third rib and a fourth rib, wherein at least one of the second, third and fourth ribs includes a series of perforations.

7. A mop system, comprising:

a elongate member having a first end and a second end, the second end providing an opening;

a grip mounted on the elongate member between the first and second end;

a wringer cup mounted on the elongate member between the grip and the second end, the wringer cup including a plurality of perforations;

a connector mounted on the second end, the connector comprising:

an insert mounted on the second end of the elongate member, the insert including, a tab with an outer portion that extends in a radially outward direction away from and transverse to the elongate member; and a collar configured to frictionally engage the outer portion of the tab; and a mop head secured to the second end of the elongate member by the connector.

8. The system of claim 7, wherein the collar comprises a chamfer, whereby the collar may be installed more readily.

9. The system of claim 8, wherein the tab is a first tab and the insert further comprises a second, third and fourth tab, the first, second, third and fourth tabs including an outer portion.

10. The system of claim 9, wherein the outer portion of the first, second, third and fourth tabs provides a circular profile, whereby the collar may engage the tabs without concern for rotational orientation.

11. The system of claim 7, wherein the wringer cup comprises a first rib, the first rib having a central portion and a side portion, the first rib having a plurality of perforations along the side portion.

12. The system of claim 11, wherein the wringer cup includes a first end and a second end and the plurality of perforations in the first rib increase in size toward the second end of the wringer cup.

13. The system of claim 7, wherein the wringer cup comprises a first, second, third and fourth rib, wherein each of the ribs includes a plurality of perforations along a side portion of the respective ribs.

14. The system of claim 13, wherein the wringer cup includes a first and second end, and wherein the plurality of perforations in the first, second, third, and fourth ribs increase in size toward the second end of the wringer cup.

* * * * *